United States Patent [19]

Soulie et al.

[11] 4,062,402

[45] Dec. 13, 1977

[54] METHOD AND APPARATUS FOR CONNECTING A RISER PIPE TO BLOW OUT PREVENTER STACK AT THE HEAD OF AN OIL WELL

[75] Inventors: Guy Soulie, Morlaas; Michel Iato, Pau, both of France

[73] Assignee: Enterprise de Recherches et d'Activites Petrolieres (E.R.A.P.), Paris, France

[21] Appl. No.: 738,302

[22] Filed: Nov. 3, 1976

Related U.S. Application Data

[63] Continuation of Ser. No. 668,313, March 18, 1976, abandoned.

[51] Int. Cl.[2] ..... E21B 7/12

[52] U.S. Cl. ..... 166/.6

[58] Field of Search ..... 166/.6

[56] References Cited

U.S. PATENT DOCUMENTS

| | | | |
|---|---|---|---|
| 3,500,906 | 3/1970 | Petersen | 166/.6 |
| 3,517,738 | 6/1970 | Petersen | 166/.6 |
| 3,675,713 | 7/1972 | Watkins | 166/.6 |
| 3,688,840 | 9/1972 | Carington et al. | 166/.6 |
| 3,899,894 | 8/1975 | Liautaud | 166/.6 |
| 3,954,137 | 5/1976 | Baugh | 166/.6 |

*Primary Examiner*—James A. Leppink

*Attorney, Agent, or Firm*—Brisebois & Kruger

[57] ABSTRACT

Method for externally connecting a riser pipe, at great depths beneath a body of water, to the B.O.P Stack of a well, said riser pipe and B.O.P Stack carrying registering eccentric tubes.

In this process the riser pipe is centered on the B.O.P Stack by resting a bearing surface on the outside of the bottom of the riser pipe on a bearing surface on the outside of the top of the B.O.P. Stack, bringing the eccentric tubes into registration by rotating the riser pipe relative to the B.O.P. Stack and mechanically connecting, seating and locking the riser pipe to the B.O.P Stack, while separating the bearing surface on the bottom of the riser pipe from the bearing surface on the top of the B.O.P Stack and, finally, connecting the eccentric tubes.

9 Claims, 4 Drawing Figures

11
12
5
14
16
15
18
19
17
20
21
22
23
24
2
4

11
29
15
28
25
27
26'
26
37
40
39
32
9
38
31
30
4'
14
17
8
33
5
34
35
24
4
36
2

METHOD AND APPARATUS FOR CONNECTING A RISER PIPE TO BLOW OUT PREVENTER STACK AT THE HEAD OF AN OIL WELL

This is a continuation, of application Ser. No. 668,313, filed Mar. 18, 1976, now abandoned.

SUMMARY OF THE INVENTION

This invention relates to a method of connecting a riser pipe with the blow out preventer stack (B.O.P Stack) of a well head beneath a great depth of water and to a device comprising locating and connecting means which are eccentric with respect to the riser pipe and the B.O.P. Stack.

In offshore oil wells, regardless of the dept of the water, the components at the sea bottom comprise, from bottom to top, three sub-assemblies:

the well head with suspensions for the various tubes;

the B.O.P. Stack and its telemetry;

the device for connecting the riser pipe and the riser pipe itself.

The guidelines which constitute the means for connecting these three sub-assemblies at depths up to about 300 meters cannot be used at greater depths and are eliminated.

In each of the two connecting steps a sonar dropped through the riser pipe makes it possible to locate the components already installed at the sea bottom and carry out an approach such that the member to be connected is brought within limits of eccentricity compatible with the radius of a funnel-shaped approach guide.

Once the approach has been completed, each sub-assembly is connected by means of a hydraulically controlled connector having a metallic sealing member which, after locking, renders the connection between the two components water-tight.

The location of the B.O.P Stack with respect to the well head takes place by simple centering, because no connection other than that of the axial passage of the well is required between these two sub-assemblies.

The location of the riser pipe with respect to the B.O.P Stack requires, in addition to centering, rotation into a position permitting the fluid-tight connection of the eccentric tubes which carry on the one hand the telemetric lines for the B.O.P Stack and, on the other hand, the ducts required for the circulation of mud.

The riser pipe is connected to the B.O.P Stack not only at the beginning of the drilling operation, but also after each disconnection following an interruption in drilling due to a substantial aggravation of the conditions of operation. Also the connecting means must be adapted to repetitive, rapid and sure use.

There is a known device for connecting a riser pipe to the B.O.P Stack of a well called an external device for oriented connection. This device comprises, on the one hand, hydraulically controlled connecting means between the lower tube of the riser pipe and a connecting spigot extending upwardly from the B.O.P Stack and, on the other hand, a bearing carried by the connecting spigot on which said bearing is threaded, together with its sealing means.

The connecting operation takes place in two steps. First, the centering and connection of the riser tube to the B.O.P Stack, and then the rotation of the assembly constituted by the riser pipe and the connecting means with respect to the B.O.P. Stack in the bearing, which rotation places the eccentric tubes carrying the telemetric control lines for the B.O.P Stack and the circuits required for the circulation of mud in a position to be connected.

The fluid-tightness of the bearing is assured by means of toroidal sealing rings. This arrangement, while not very reliable, is satisfactory for depths not exceeding 300 meters when all the B.O.P Stack are situated beneath the bearing. It presents substantial dangers when a plug is positioned above the bearing, but this arrangement is envisaged in the following embodiment for wells beneath great depths of water.

The bearing supports all the static force corresponding to the weight of the riser pipe; it is also subject to flexi forces resulting from the displacement of the floating drilling barge; these different stresses may provoke deformations in the components of the bearing prejudicial to carrying out subsequent operations.

The present invention makes it possible to reduce these disadvantages by providing means for completing the locating step, including the centering and rotary positioning, before proceeding to the connection of the riser pipe to the B.O.P Stack, so that the weight of the column is not then supported by the bearing.

In the process according to the invention for connecting a riser pipe to the B.O.P Stack of a well head, in which the riser pipe and the well head carry eccentric tubes which must be brought into registration, the riser pipe is centered on the B.O.P Stack by causing a downwardly oriented bearing surface on the lower end of the riser pipe to rest solely on an upwardly oriented bearing surface on the B.O.P Stack. The eccentric tubes are brought into position by rotation of the riser pipe with respect to the B.O.P Stack. They are connected mechanically in a fluid-right manner and the riser pipe is locked to the B.O.P Stack while simultaneously separating the bearing surface at the bottom of the riser pipe from the bearing surface at the top of the B.O.P Stack. Finally, the eccentric tubes are connected.

In an external device for connecting a riser pipe with the B.O.P Stack of a well head on the one hand, the B.O.P Stack carries eccentric tubes for the telemetric lines and the ducts required for the circulation of mud and extends upwardly in the form of a connecting spigot and, on the other hand, the riser pipe extends downwardly in the form of a tip equipped with an annular metallic sealing member, said tip comprising a telemetricly controlled device for locking said annular metallic joint, an approach guide in the form of an inverted funnel, eccentric tubes for the telemetric lines and the ducts required for the circulation of mud, and means for rotationally positioning the tube end so that the eccentric tubes may be connected together.

The device according to the invention, for use at great depths of water, comprises at least three fluid-operated jacks utilized during the approach and regularly distributed about the tip of the riser pipe, which tip has a downwardly oriented bearing surface which, in the approach position, bears on an upwardly oriented annular bearing surface supported by an annular bearing fixed to the exterior of the B.O.P Stack.

In accordance with one embodiment, the jacks used during the approach are fastened on the periphery of the approach guide which has the shape of an inverted funnel and is itself fixed to the tip of the riser pipe.

In accordance with a preferred embodiment of the invention the approach jacks are attached at one end to the periphery of the tip of the riser pipe and at the other end to a sheath which slides along said tip and merges into the approach guide, said sliding sheath being immobilized against rotation by at least one finger sliding in a longitudinal groove on the external surface of the riser pipe tip.

In accordance with another embodiment the approach jacks are attached at one end to the periphery of the riser pipe tip and at the other end to a sheath sliding along said tip and merging into the inner part of the approach guide, to which it is connected by a plurality of ribs, said ribs passing through a corresponding number of orifices in a cylindrical extension which connects the outer part of the approach guide to the riser pipe tip, the sheath being immobilized against rotation by at least one finger sliding in a longitudinal groove in the outer surface of the riser pipe tip. In each of the two latter embodiments the annular bearing on the outside of the B.O.P Stack may be fastened to the connecting spigot which extends upwardly from this B.O.P Stack.

The invention will be better understood from the following description, given purely by way of example, of several embodiments of the invention, illustrated by the accompanying drawings:

Figure 1:
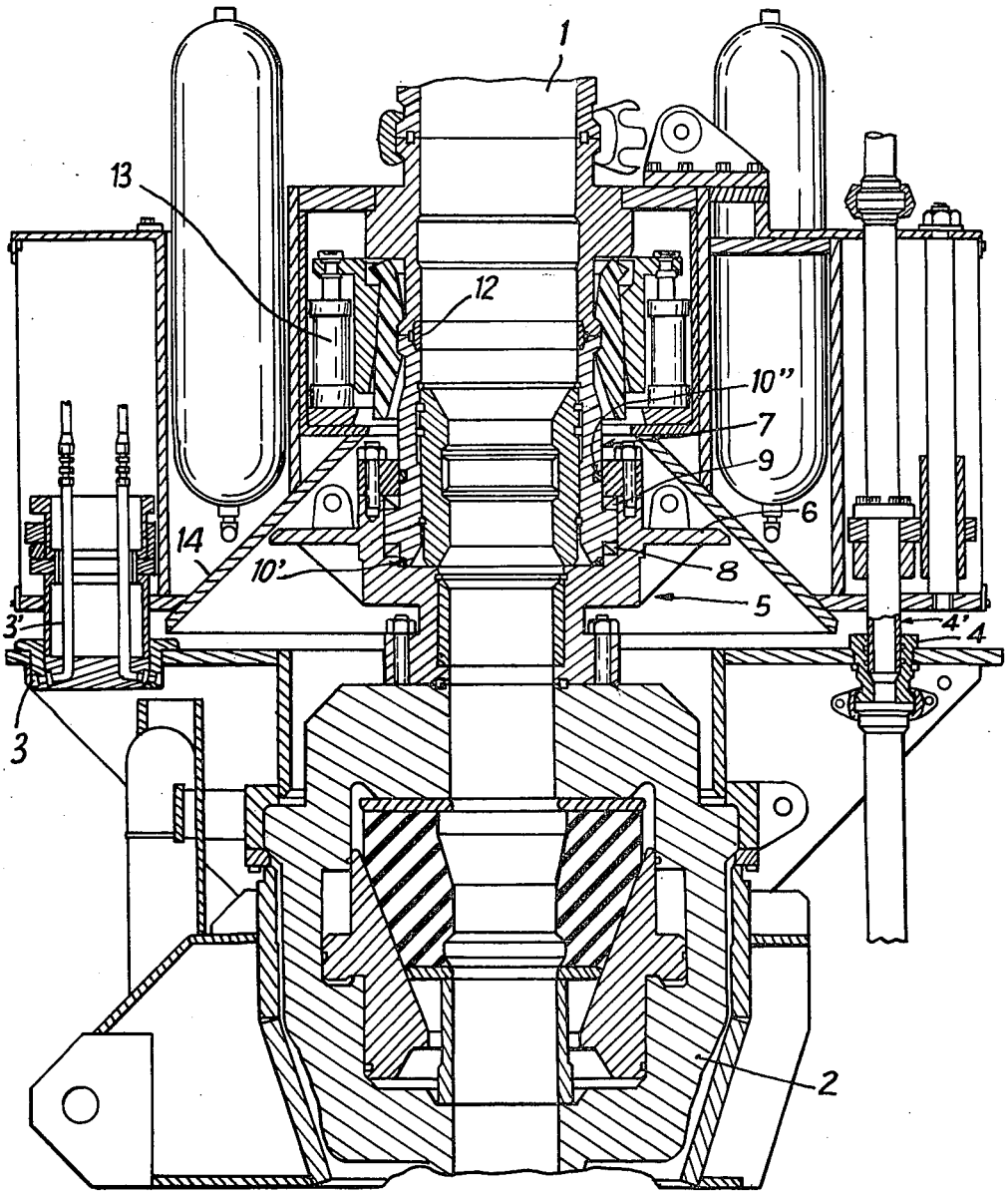
FIG. 1 is an axial sectional view taken through a connecting device of a type presently in use.

Referring now to FIG. 1, this shows an external connector of the type actually in use positioned between a riser pipe 1 and a B.O.P Stack 2.

The B.O.P Stack, a device known in itself, carries eccentric tubes, a tube 3 for the telemetric lines and a tube 4 for the ducts used in circulating the mud. The tubes 3 and 4 are positioned on opposite sides of the central duct of the B.O.P Stack which carries an upwardly extending connecting spigot 5. The spigot 5 comprises a socket 6 attached to the B.O.P Stack 2 and receives an annular member 7, said annular member 7 being supported in the socket 6 by a double bearing consisting of a bearing 8 at the bottom and a bearing 9 at the top. The annular member 7 is mounted in the socket 6 between sealing rings 10' and 10'' separating the space in which the bearings are located, on the one hand, from the drilling mud and, on the other hand, from the sea water.

The riser tube has at its lower end a tip 11 equipped with a metallic connector 12, said tip comprising a device 13 for retaining the metallic connector, a guide 14 having the shape of an inverted funnel, and eccentric ducts 3' and 4' corresponding to the ducts 3 and 4 of the well head at a position determined by the rotation of the tip with respect to the B.O.P Stack.

The connection is completed in three steps. The first step comprises the centering of the tip 11 on the annular member 7, the seating of the tip and the connection of said tip to the annular member 7 by means of the metallic connector 12 under the control of fastening means 13 which is telemetricly controlled. The second step consists in the rotation of the riser pipe together with the annular member 7 with respect to the B.O.P Stack by means of the double bearing 8 and 9 so as to bring the eccentric tube ends 3' and 4' into registration with the tube ends 3 and 4. The third step consists of the connection of the eccentric tubes 3 and 4 to 3' and 4'.

Figure 2:
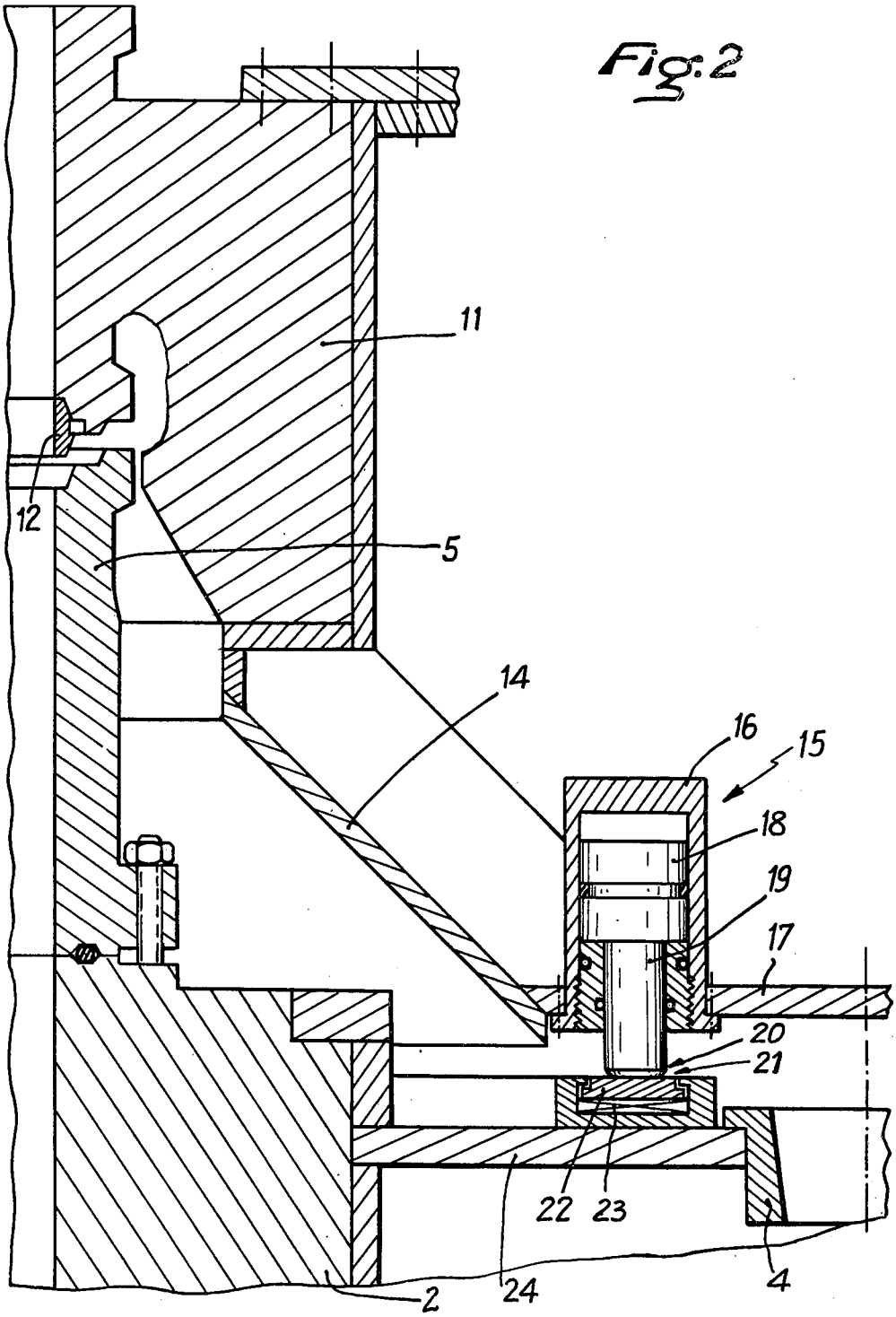
FIG. 2 is a partial axial sectional view taken through connecting means equipped with approach jacks attached to the periphery of the approach guide.

FIG. 2 shows between a riser pipe 1 and a blow-out preventer stack 2, the same as on FIG. 1, an embodiment of the connecting device according to the invention in which the approach jacks 15 are attached at one end to the periphery of approach guide 14 in the shape of an inverted funnel. The approach guide 14 is attached to the tip 11 which constitutes the lower end of the riser tube, not shown. In the embodiment illustrated, the approach jacks 15 each comprise on the other hand, a cylinder 16 attached to an annular plate 17 which is itself attached to the periphery of the approach guide 14 and, on the other hand, a piston 18 traveling in the cylinder 16, said piston 18 being mounted on a steel rod 19. The end of the rod 19 remote from the piston 18 constitutes a bearing surface 20 which is downwardly oriented and which, in approach position, bears on an upwardly oriented annular bearing surface 21 on the upper surface of a steel ring 22. The ring 22 is supported by an annular bearing 23 attached to an annular plate 24 which is itself attached to the outer surface of the B.O.P Stack. The bearing surface 22 may consist of a Teflon ring or a ball bearing race. The approach jacks 15 are shown on FIG. 2 in a position of maximum extension, the connecting device being in approach position. The connecting ring 12 fixed to the tip 11 is separated from the spigot 5 by a distance of several centimeters, a distance several millimeters less than the stroke of the piston 18. Under these conditions, by imparting a rotary movement to the riser pipe, it is possible to bring the connecting means into the position in which the ends of the eccentric tubes for the telemetric control lines and the circulation of mud carried by the riser pipe are in register with those on the well head.

The device for locking the connecting ring 12 is not illustrated because the device 13 of FIG. 1 may be used for this purpose. After approach and centering, the approach jacks 15 in their extended position, maintain a space of several centimeters between the connector 12 and the upper surface of the spigot 5. One may then proceed to the rotation with a view to connecting the eccentric tubes 3' and 4' to 3 and 4.

By purging the approach jacks 15, the connecting ring 12 is positioned on the spigot 5 and it then becomes possible to lock the connecting ring 12 and consequently the tip 11 to the spigot 5.

The bearing surfaces 20 and 21 are then separated by several millimeters and contact between the sleeve and the spigot is limited to the connecting ring 12 and the locking device.

This solution can be used when there is compatability from the point of view of diametral bulk between the location of the jacks at the periphery of the guide 14 and the position of the eccentric tubes.

Figure 3:
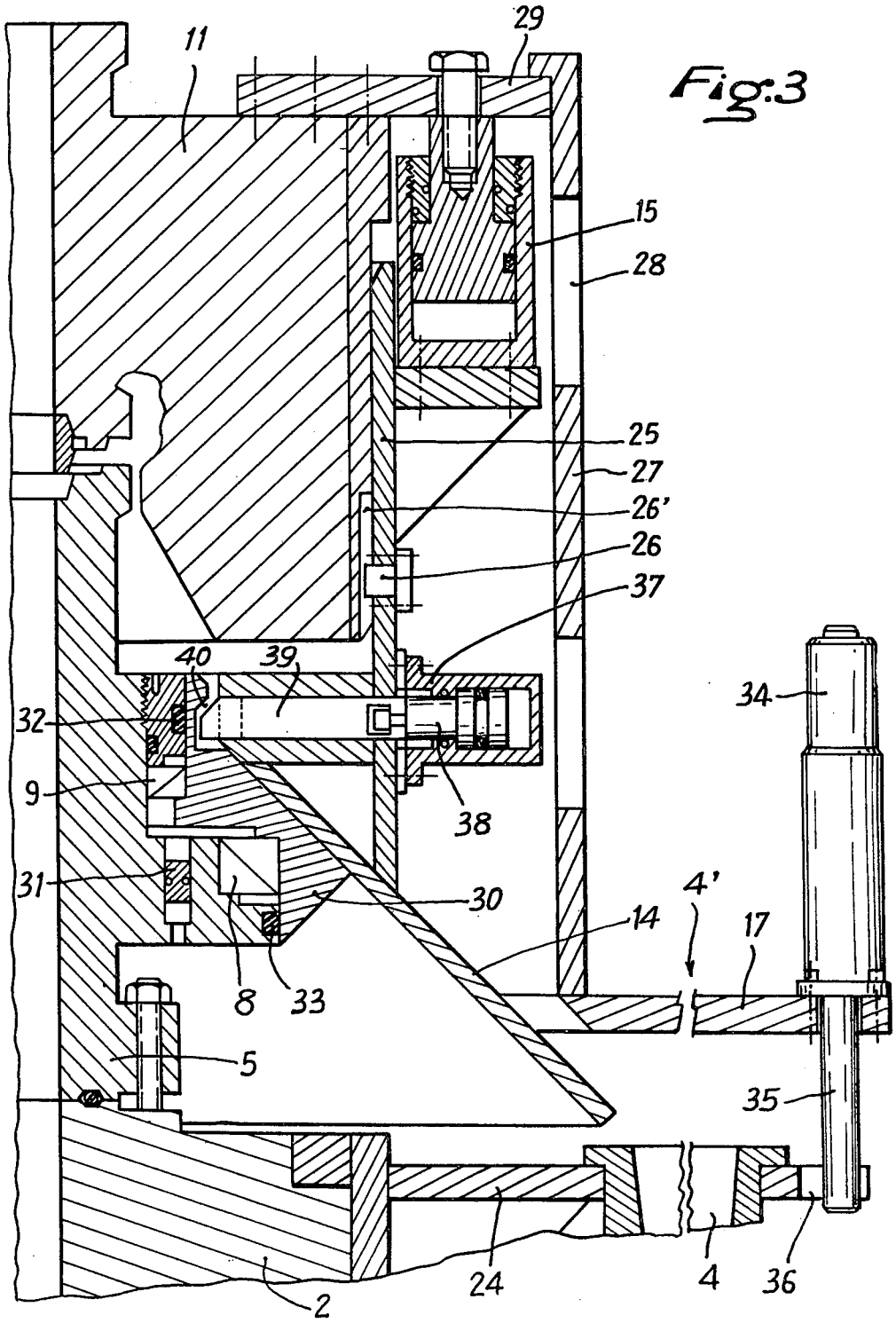
FIG. 3 is a partial axial sectional view of an external connecting device having approach jacks attached to the periphery of the riser pipe tip.

FIG. 3 shows between a riser pipe 1 and blow out preventer stack 2, the same as on FIG. 1, an embodiment of the external connecting means in which each of the approach jacks 15 are attached at one end to the periphery of the tip 11 and attached at the other end to a sheath 25 which is slidable along the tip 11 and merges into the approach guide 14 having the shape of an inverted funnel. The longitudinal stroke of the sheath 25 with respect to the tip 11 is equal to the stroke of the jack 15. FIG. 26 prevent rotation of the sleeve 25 with respect to the tip 11 but permit longitudinal translation movements.

An annular plate 17 is attached to the tip 11 by means of a cylindrical casing 27 having several service openings such as 28 and a fastening ring 29. The plate 17 carries the eccentric tubes 3' and 4' for the telemetric line and the circulation of mud, said tubes being positioned customarily and for reasons of convenience in diametrically opposed positions.

The B.O.P Stack 2 carries an upwardly extending spigot 5. The approach guide 14 bears on the spigot 5 through a double bearing consisting of a lower bearing 8 and an upper bearing 9. The bearings 8 and 9 consist of roller or needle bearings or Teflon discs. The approach guide 14 rests on a member 30 forming part of the double bearing.

The annular space between the member 30, the spigot 5, and the bearings 8 and 9 is connected to the external sea water by means of a valve 31 for equalizing the pressure.

Sealing rings 32 and 33 are positioned on opposite sides of the bearings in order to prevent the circulation therethrough of water charged with impurities.

The B.O.P Stack 2 carries, fixed to its upper part, an annular plate 24, to which the tubes 3 and 4 are attached in positions such that, for a particular orientation of the plate 17 with respect to the plate 24, the tubes 3 and 4 are in register with the tubes 3' and 4' carried by the plate 17.

On the plate 24 fixed to the tip 11 of the riser tube 1 is a jack 34 having an axis perpendicular to the plate 17. The jack 34 is equipped with a rod 35 mounted for translational movement. The rod 35, when in index position, penetrates into a cavity 36 in the plate 24.

At least two jacks 37 are attached to the sheath 25, and comprise rods 38 mounted for translational movement in directions perpendicular to the axis of the spigot 5. These rods terminate in bolts 39 and ends of which penetrate into cavities 40 in the periphery of the member 30. The cavities 40 are provided at their upper ends with a chamfer 40' corresponding to a chamfer 39' on the bolts 39.

The bolts 39 may in other embodiments enter cavities formed, not in the member 30, but in the spigot 5 or in a ring fixed to the spigot. In this case the cavities must be constituted by an annular ring having a straight section 40 provided with a chamfer 40' near the top of the straight section, said chamfer 40' corresponding to the chamfer 39' of the bolts 39.

The operation of this embodiment comprises, after centering the guide 14, the approach. When the guide 14 rests on the member 30, the connecting ring 12 at the end of the tip 11 is separated from its seat on the end of the spigot 5 by a distance several millimeters less than the stroke of the jack. This distance is provided during construction.

The latching of the guide 14 on the member 30 makes it possible to bring about the rotation which results in indexing without risk of relative displacement of the member.

After indexing, the purging of the jacks leads to the positioning of the connecting ring 12 on its seat and to the latching of the tip of the riser tube to the spigot of the B.O.P Stack.

Since, by construction, in approach position, the distance between the connecting ring 12 and the spigot 5 is several millimeters less than the stroke of the jacks 15, after purging of the jacks the guide 14 will separate from the member 30 by a distance equal to the difference between the distance indicated above and the stroke of the jacks 15. Thus, in addition to the steps of approaching and indexing, the approach guide 14 is subjected to no stress which could be transmitted to it by the components of the B.O.P Stack if they were in contact with the guide 14.

The chamfer 40' facilitates the release in an upward direction of the bolts 39 after purging of the jacks 15.

Figure 4:
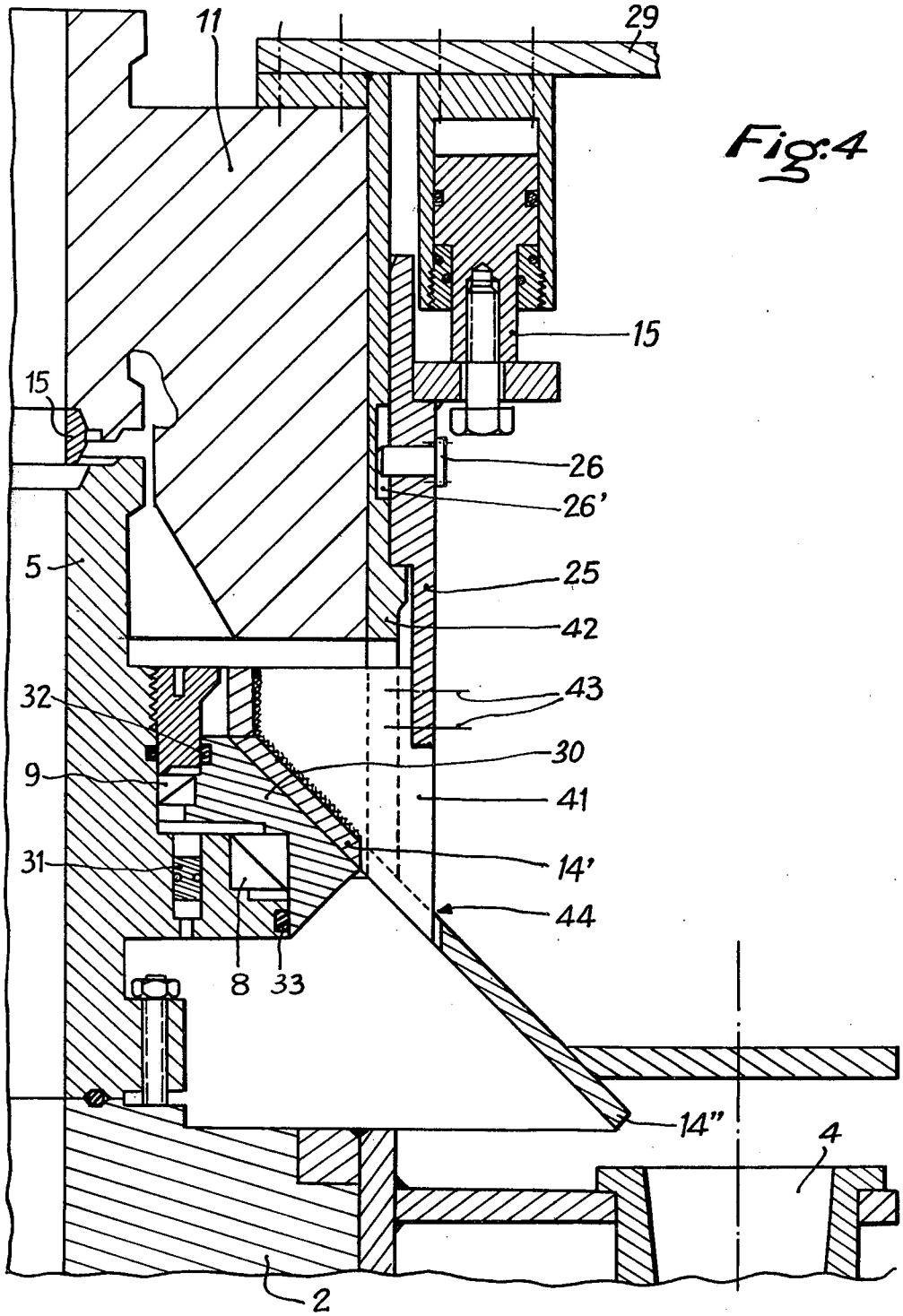
FIG. 4 is an axial sectional view showing a modification of the connector of FIG. 3.

FIG. 4 shows an embodiment of the device for connecting a riser pipe to the casing plug of a well-head, in which embodiment the approach jacks 15 are fastened at one end to the periphery of the tip 11 and at the other end to a sleeve 25 which slides along the tip 11. The sleeve is connected by the internal part 14' of the approach guide by a plurality of ribs 41. The ribs 41 pass through a corresponding number of orifices 42 in a ferrule 43 which fastens the external part 14' of the approach guide to the tip.

The sleeve 25 is immobilized against rotation by at least one finger 26 entering a groove 26' formed longitudinally in the external surface of the tip.

In order to permit separation, the flat ribs 41, the median planes of which pass through the tip, are welded on the internal part of the approach guide and fastened to the sheath 25 by means of bolts 43. For the same reason the identations 44 are formed in the funnel 14" to the right of each rib.

The spigot 5 comprises the same double bearing which has been described in the case of FIG. 3. The latching devices of the internal part of the approach guide on the bearing as well as the indexing device are like those of FIG. 3. The arrangements described in connection with FIG. 3 make it possible to produce a device in which the access to the approach jacks and the latching is easier than in the preceding embodiment.

What is claimed is:

1. Method of connecting a riser pipe with a B.O.P Stack at a well head beneath a greath depth of water, said riser pipe and B.O.P Stack carrying corresponding eccentric tubes, which method comprises the steps of:

successively centering the riser pipe on the B.O.P Stack by resting only at least one downwardly oriented member on the riser pipe on an upwardly oriented member on the B.O.P Stack, bringing the eccentric tubes into a registering position by rotating the riser pipe with respect to the B.O.P Stack, on a low friction bearing on one of the members, and mechanically connecting and latching the riser pipe to the B.O.P Stack to form a fluid-tight seal therebetween while separating said at least one member on the riser pipe from the member on the B.O.P Stack, and finally connecting the eccentric tubes.

2. A method according to claim 1, wherein said step of rotating comprises rotating the riser pipe with respect to the B.O.P Stack on a low friction bearing surface on one of said members.

3. A method according to claim 1 wherein said step of rotating comprises rotating the riser pipe with respect to the B.O.P Stack on a low friction bearing on the upwardly oriented member on the B.O.P. Stack.

4. In a device for connecting a riser pipe to the B.O.P Stack of a well head, said B.O.P. Stack carrying a connecting spigot at its upper end and at least one service tube positioned eccentrically with respect to the axis of the B.O.P. Stack, while said riser pipe carries a sealing member at its lower end, telemetrically controlled apparatus for latching the sealing member in sealing position, a downwardly open approach guide, and at least one service tube positioned to register with the service tube on said stack when said stack and pipe are in both axial alignment with each other and occupy a predetermined angular position with respect to each other, the improvement according to which said riser pipe carries at least one member having a downwardly oriented bearing surface and said B.O.P. Stack has a component with an upwardly oriented bearing surface, said bearing surfaces being positioned to bear against each other when said riser pipe and B.O.P. Stack have been guided into axial alignment by said approach guide, said riser pipe carries fluid pressure means positioned to act between said pipe and said at least one member having a downwardly oriented bearing surface and adapted to lower said sealing member into contact with said spigot after said upwardly and downwardly oriented surfaces have come into contact with each other, and said riser pipe has been rotated on said bearing surfaces to bring said service tubes into registration with each other, in which the fluid pressure cylinders are attached at one end to the periphery of the tip and at the other end to a sleeve slidable along said tip and attached to the approach guide, said slidable sleeve being immobilized against rotation by at least one finger sliding in a longitudinal groove in the external surface of the tip, and in which the annular bearing surface on the B.O.P Stack is on said connecting spigot.

5. In a device for connecting a riser pipe to the B.O.P. Stack of a well head, said B.O.P. Stack carrying a connecting spigot at its upper end and at least one service tube positioned eccentrically with respect to the axis of the B.O.P. Stack, while said riser pipe carries a sealing member at its lower end, telemetrically controlled apparatus for latching the sealing member in sealing position, a downwardly open approach guide, and at least one service tube positioned to register with the service tube on said stack when said stack and pipe are in both axial alignment with each other and occupy a predetermined angular position with respect to each other, the improvement according to which said riser pipe carries at least one downwardly oriented member and said B.O.P. Stack has a component with an upwardly oriented member, said members being positioned to bear against each other when said riser pipe and B.O.P. Stack have been guided into axial alignment by said approach guide, a low friction bearing on one of said members, and said riser pipe carries fluid pressure means positioned to act between said pipe and said at least one downwardly oriented member and adapted to lower said sealing member into contact with said spigot after said upwardly and downwardly oriented members have come into contact with each other, and said riser pipe has been rotated on said low friction bearing to bring said service tubes into registration with each other.

6. Connecting device as claimed in claim 5 in which said fluid pressure means comprise cylinders attached to the periphery of the approach guide, which is itself attached to the riser pipe tip.

7. Connecting device as claimed in claim 5 in which the fluid pressure means comprise cylinders attached at one end to the periphery of the riser pipe tip and at the other end to a sleeve slidable along said tip and attached to the approach guide, said slidable sleeve being immobilized against rotation by at least one finger sliding in a longitudinal groove in the external surface of the tip.

8. Connecting device as claimed in claim 5 in which said approach guide is divided into inner and outer parts, and said inner part is carried on a sleeve slidably mounted on the tip of said riser pipe, said sleeve being prevented from rotating by a finger carried by said sleeve which projects into a longitudinal groove in the outer surface of said riser pipe tip, said outer part being carried by a cylindrical member attached to said riser pipe tip and radially inward of said sleeve, said sleeve being connected to said inner part by a plurality of ribs passing through corresponding orifices in said cylindrical member.

9. Device as claimed in claim 5 in which said approach member has the shape of an inverted funnel.

* * * * *